US006457805B2

(12) United States Patent
Ohtani et al.

(10) Patent No.: US 6,457,805 B2
(45) Date of Patent: Oct. 1, 2002

(54) RECORDING APPARATUS AND RECORDING METHOD

(75) Inventors: Tsuyoshi Ohtani; Shuji Inoue, both of Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,967

(22) Filed: Mar. 13, 2001

(30) Foreign Application Priority Data

Mar. 15, 2000 (JP) ..... 2000-073017
Jul. 11, 2000 (JP) ..... 2000-210089

(51) Int. Cl.[7] ..... B41J 29/38
(52) U.S. Cl. ..... 347/37
(58) Field of Search ..... 347/7, 14, 37; 400/121; 318/696

(56) References Cited

U.S. PATENT DOCUMENTS 4,877,343 A * 10/1989 Hori ..... 400/121
5,617,122 A 4/1997 Numata et al. ..... 347/14
5,998,956 A * 12/1999 Saito ..... 318/696

* cited by examiner

*Primary Examiner*—Anh T. N. Vo
(74) *Attorney, Agent, or Firm*—Fitzpatrick, Cella, Harper & Scinto

(57) ABSTRACT

A recording apparatus which performs recording by scanning across a recording medium a carriage mounted with a recording head and which is configured to be capable of setting a carriage moving speed for scanning out of a plurality of values, it is possible to perform recording in a short time irrespective of record widths by calculating the record widths for recording by scans and selecting out of the plurality of values a carriage moving speed at which a total of periods for all scans from start to stop of a carriage is shortest.

20 Claims, 8 Drawing Sheets

RECORDING APPARATUS AND RECORDING METHOD

BACKGROUND OF THE INVENTION

1. Field of the Invention

The present invention relates to serial scan type recording apparatus and method which record an image on a recording medium while scanning a recording head.

2. Related Background Art

As a control method of a recording head moving motor for moving a recording head in this kind of recording apparatus, there is known a method which uses motor driving tables corresponding to record modes.

Conventionally, only a motor driving table corresponding to a set record mode has been used. When a high speed recording mode is set, for example, only a motor driving table corresponding to the high speed recording mode is used to move a recording head stably at a high speed in a recording area.

In other words, a record mode in which a carriage is moved at a highest speed is selected fixedly out of support modes irrespective of a kind and a size of an image to be recorded when the high speed recording mode is selected.

For moving a recording head stably at a high speed in a recording area, however, the motor driving table corresponding to the high speed recording mode requires a large amount of movement of the recording head for acceleration of the recording head moving motor. When a small image which has a small recording amount is recorded using a motor driving table corresponding to the high speed recording mode, for example, an accelerating area required for acceleration of the recording head driving motor may be larger than a recording area for recording the image, thereby making it impossible to perform high speed recording.

This is because a carriage acceleration/deceleration profile is constant irrespective of a recording mode, and a time required for a carriage to reach a desired speed and a time required to stop the carriage from the desired speed are always longer than those in another mode.

SUMMARY OF THE INVENTION

An object of the present invention is to provide a recording apparatus and a recording method which select an optimum motor driving table as a motor driving table to be used for controlling a recording head moving motor, thereby being capable of remarkably enhancing recording operation throughput.

Another object of the present invention is to provide a recording apparatus and a recording method which perform recording operations in a high speed recording mode in a time shorter than that in another record mode.

In order to attain the objects described above, the present invention provides a recording apparatus for recording an image on a recording medium while scanning a recording head with a driving force of a motor, comprising control means which is capable of controlling the above described motor by selectively using a plurality of motor driving tables and selecting means for selecting a motor driving table to be used by the above described control means out of the above described plurality of motor driving tables according to recording data of an image to be recorded on a recording medium.

Furthermore, the present invention provides a recording method for recording an image on a recording medium while scanning a recording head with a driving force of a motor, wherein a motor driving table to be used for controlling the above described motor is selected out of a plurality of motor driving tables according to recording data of an image to be recorded on a recording medium at a stage to control the above described motor by selectively using the above described plurality of motor driving tables.

Furthermore, the present invention provides a recording apparatus which records an image by scanning on a recording medium a carriage mounted with a recording head and is configured to be capable of selectively setting, at a stage of the above described scanning, a carriage moving speed out of a plurality of values according to a recording mode, comprising record width calculating means for calculating recording widths for recording by scans and moving speed selecting means for selecting out of the above described plurality of values a carriage moving speed at which a total of periods for all scans from start to stop of a carriage is shortest at each of the recording widths in a high speed recording mode.

Furthermore, the present invention provides a recording speed control method for a recording apparatus which performs recording by scanning on a recording medium a carriage mounted with a recording head and is configured to be capable of selectively setting a carriage moving speed out of a plurality of values at a stage of the above described scanning, comprising a record width calculating step of calculating record widths for recording by scans and a moving speed selecting step of selecting out of the above described plurality of values a carriage moving speed at which a total of periods for all scans is shortest at each of the above described record widths.

The recording apparatus according to the present invention is a recording apparatus which performs recording by scanning across a recording medium a carriage mounted with a recording head and is configured to be capable of selecting a carriage moving speed out of a plurality of values at a scan stage, wherein a record width for recording by each scan is calculated and a carriage moving speed at which a total of periods for all scans required from start to stop of the carriage is selected out of the plurality of values for each of the record widths.

The image forming apparatus which is configured as described above selects the carriage moving speed so that the total of periods for all scans is the shortest at each scan, thereby always shortening a time required for entire recording irrespective of an image to be recorded. Furthermore, the shortest total of periods for all scans reduces a carriage stroke width (moving range) to a required minimum, thereby providing also an effect to allow the image forming apparatus to produce minimum noise and consume power in a small amount.

DETAILED DESCRIPTION OF THE PREFERRED EMBODIMENTS

Now, preferable embodiments of the present invention will be described in detail with reference to the accompanying drawings.

In the embodiments described below, a printer will be taken as an example of a recording apparatus which uses ink jet recording technology.

In this specification, "recording" ("printing" may be used instead) is to be interpreted as a term which widely means not only formation of significant information such as characters and figures but also formation of images, markings, patterns or the like on recording media or working the recording media whether or not the images, markings, patterns or the like are significant or visualized so as to be perceivable by man.

Furthermore, "recording medium" is to be interpreted as a term which widely means not only paper which is generally used in recording apparatuses but also materials which are capable of accepting ink such as cloth, plastic films, metal sheets, glass, ceramics, wood, leather or the like.

Furthermore, "ink" ("liquid" may be used instead) is to be interpreted widely like a definition of "ink (printing)" and expresses liquids which can be applied to or deposited on the recording media for forming images, marking, patterns or the like or treating ink (for example, coagulating or insolubilizing coloring materials contained in the ink applied to the recording media).

The embodiments of the present invention will be described below on the basis of the accompanying drawings.

First Embodiment

Figure 6:
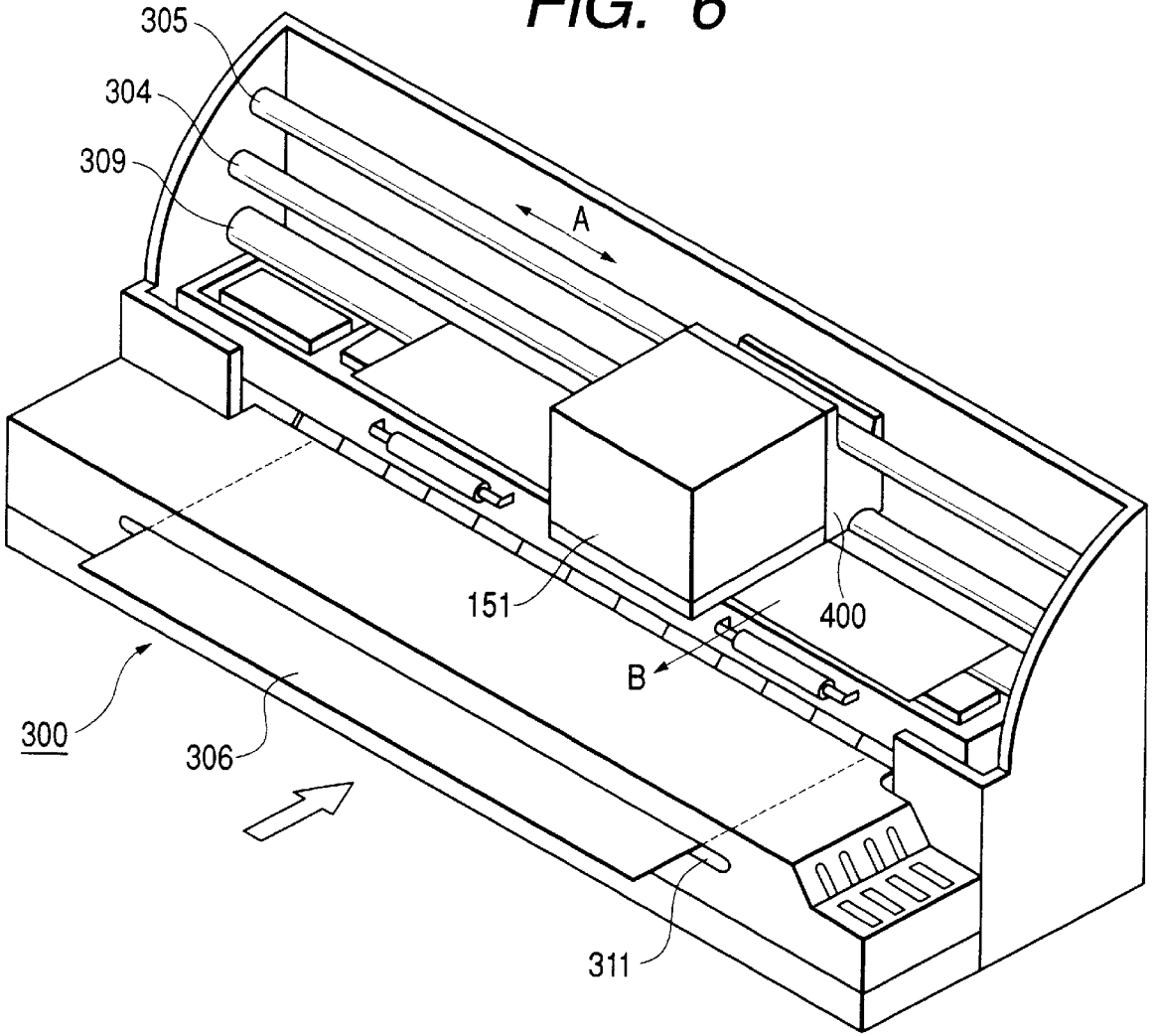
FIG. 6 is a schematic perspective view of a recording apparatus to which the present invention is applicable.

FIG. 6 is a perspective view of a recording apparatus 300 to which the present invention is applicable. In a first embodiment, the recording apparatus 300 is an ink jet recording apparatus for forming an image using an ink jet recording head which is capable of discharging ink. Usable as the ink jet recording head is a recording head having an electrothermal converting element which generates a heat energy as an ink discharging energy. Furthermore, a recording system of the recording apparatus is not limited to only an ink jet recording system described above and the recording apparatus can adopt various kinds of recording systems such as a thermal transferring type recording system. Furthermore, the recording apparatus can function as an image reading apparatus when an image reading head is mounted in place of or in combination with the recording head.

In FIG. 6, reference numeral 400 denotes a carriage which is guided by guide shafts 304 and 305 so as to be reciprocally movable in a main scanning direction indicated by an arrow A and reciprocally moved by a carriage driving mechanism configured by a carriage driving motor (recording head moving motor), a driving force transmitting belt or the like. Reference numeral 151 denotes a recording head which can be mounted on the carriage 400 and, in case of the first embodiment, the recording head is an ink jet recording head which can discharge ink and forms an ink jet cartridge together with an ink tank for containing ink. On the carriage 400, an image reading head can be mounted in place of the recording head 151 and, in such a case, the recording apparatus functions as an image reading apparatus. A plurality of ink ejection orifices are formed in a sheet conveying direction B (sub-scanning direction) on a surface of the recording head 151 which is opposed to a sheet 306 used as a recording medium, and electrothermal converting elements, which generate heat energies for discharging ink are disposed in ink paths communicated with the ink ejection orifices. When an electrothermal converting element is provided with electric pulses according to driving data, it generates heat and when film boiling is caused by the heat, ink droplets are discharged from the corresponding ink ejection orifice as bubbles grow in the ink. The sheet 306 which is inserted through an insertion slot 311 is inverted in its conveying direction and then is conveyed by a feed roller 309 in the sub-scanning direction B. An image is recorded on the sheet 306 at a position located on a platen 308 which is opposed to the recording head 151.

The recording apparatus 300 having the above described configuration which is of a serial scan type records an image consecutively on the sheet 306 by repeating a recording operation of the recording head 151 with the movement of the carriage in the main scanning direction A and a conveying operation of the sheet 306 in the sub-scanning direction B. When the image reading head is mounted in place of the recording head 151, an original on which an image is recorded is set in place of the sheet 306, and the image recorded on the original is read consecutively by repeating an image reading operation of the image reading head with the movement of the carriage in the main scanning direction A and the conveying operation of the original in the sub-scanning direction B.

Figure 1:
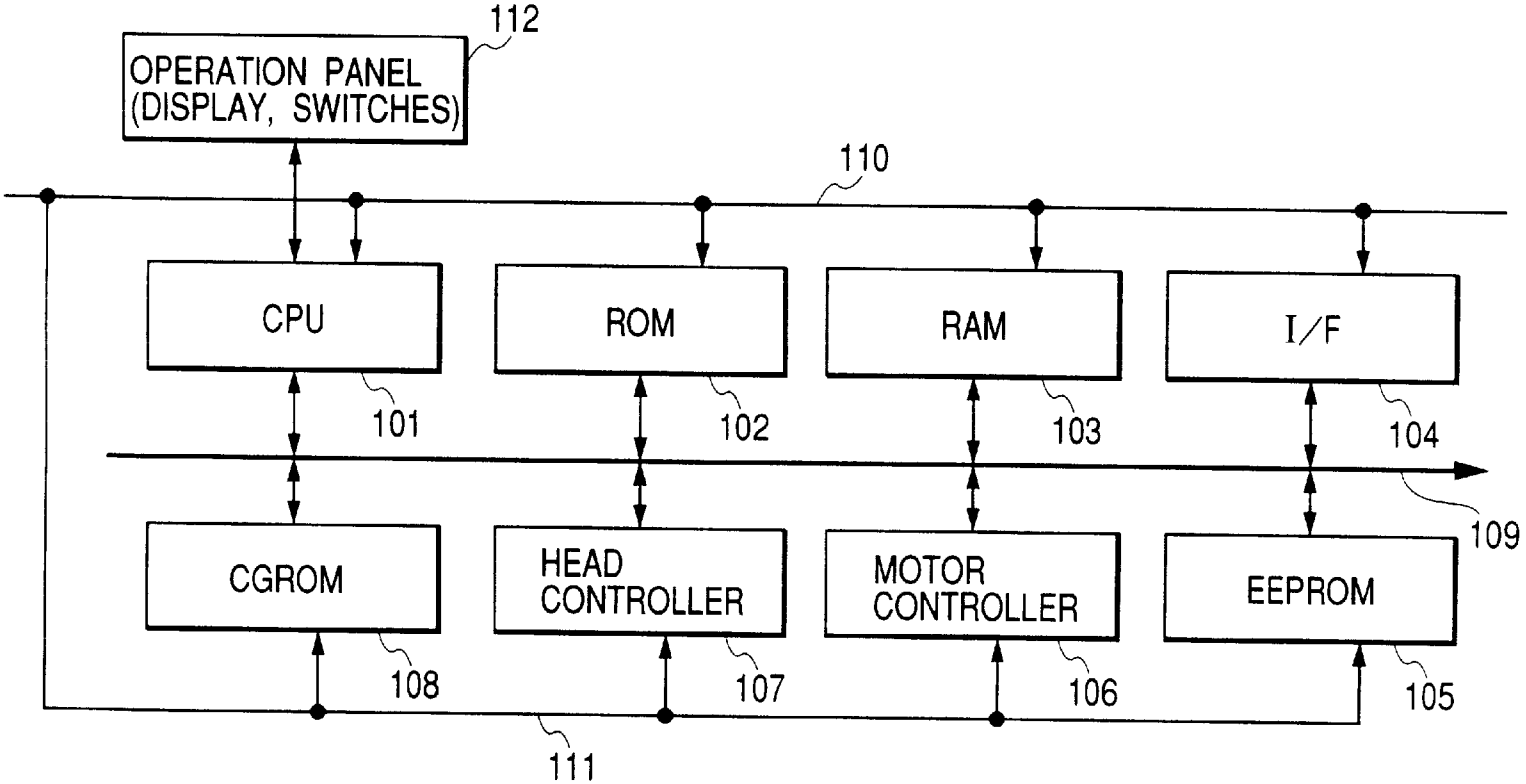
FIG. 1 is a configurational block diagram of a control system according to an embodiment of the present invention.

FIG. 1 is a schematic block diagram of a control system in the recording apparatus.

In FIG. 1, a CPU 101 performs various kinds of control operations for generation of recording data in the recording apparatus, driving control of various kinds of motors including the carriage driving motor, driving control for discharging ink droplets from the recording head 151, analysis of a command transferred from a higher-ranking apparatus such as a host apparatus, setting of a record mode with an input from an operation panel (display/switches) 112 of the recording apparatus or the like. Stored in a ROM 102 are control software for the recording apparatus, various kinds of data, font data to be used for printing or the like. A program stored in the ROM 102 is read out and executed by the CPU 101. The various kinds of data stored in the ROM 102 are used as initial values with no modification or developed in a RAM 103 and processed by the CPU 101 for use. The font data is designated and read out by the CPU 101 as occasion demands, developed in the RAM 103 and generated as recording data for printing. A volume of the font data is not constant since a number and kind of installed character styles are different dependently on a kind of a recording apparatus. The recording apparatus according to the first embodiment uses a font of Ming style. Furthermore, stored in the ROM 102 are motor driving tables for controlling the carriage driving motor according to the record operation modes. For simplicity of description, in the first embodiment it is assumed that the ROM 102 stores two (first and second) motor driving tables which are selectable for controlling the carriage driving motor when the high speed recording mode is set.

Data which is modified by using designated font data is developed in the RAM 103 and this data is used as recording data for printing. In the case of image data, image data which is read by the CPU 101 is similarly developed in the RAM 103 and used as recording data for recording an image. The RAM 103 is used also as a work area for executing the program and a reception buffer area for temporarily storing input data from an I/F 104. The I/F 104 is used for receiving data such as the recording data and a record designation command from a host apparatus (not shown). The I/F 104 used in the first embodiment has electrical specifications in compliance with IEEE-1284 and is configured to allow bidirectional communication for transferring not only data from the host apparatus but also information of the recording apparatus to the host apparatus.

Stored in an EEPROM 105 is not only information of a set state of the recording apparatus but also other information such as a number of recording sheets 306 and a residual amount of ink. Stored as the set state of the recording apparatus is various kinds of information such as a kind of font, a kind of corresponding paper and functional items such as an ON/OFF state of a power supply. A motor controller 106 controls a carriage driving motor for moving the carriage 400 in the main scanning direction A and a sheet conveying motor (line feed motor) for conveying the sheets 306 in the sub-scanning direction B. Under the control of the CPU 101, the motor controller 106 controls the carriage driving motor and the sheet conveying motor interrelatedly so as to correspond, for example, to a case where recording for each line is completed by a single scan of the recording head 151 or a case where recording for each line is completed by plural scans of the recording head 151. Accordingly, the sheet 306 is conveyed by a predetermined amount each time the recording head 151 performs the single scan or the plural scans. A recording operation of the recording head 151 is performed in a uniform motion area of the carriage driving motor which moves the carriage 400 at a constant speed. The carriage driving motor and the sheet conveying motor can be driven independently, whereby the carriage driving motor is driven for the single scan or the plural scans of the recording head 151 and then the sheet conveying motor is driven to convey the sheets 306 by the predetermined amount as described above.

Reference numeral 107 denotes a controller which controls the recording head 151 or the image reading head mounted on the carriage 400. When the image reading head is mounted on the carriage 400, the sheet conveying motor functions as an original conveying motor.

Reference numeral 108 denotes a CGROM which stores information for converting a character code into the recording data. Reference numeral 109 denotes a bus line which has a data bus for data transferring and an address bus. Using the bus line 109, the CPU 101 controls the elements 102 through 108. Reference numerals 110 and 111 denote power supply lines for supplying power to the elements 102 through 108.

Figure 2:
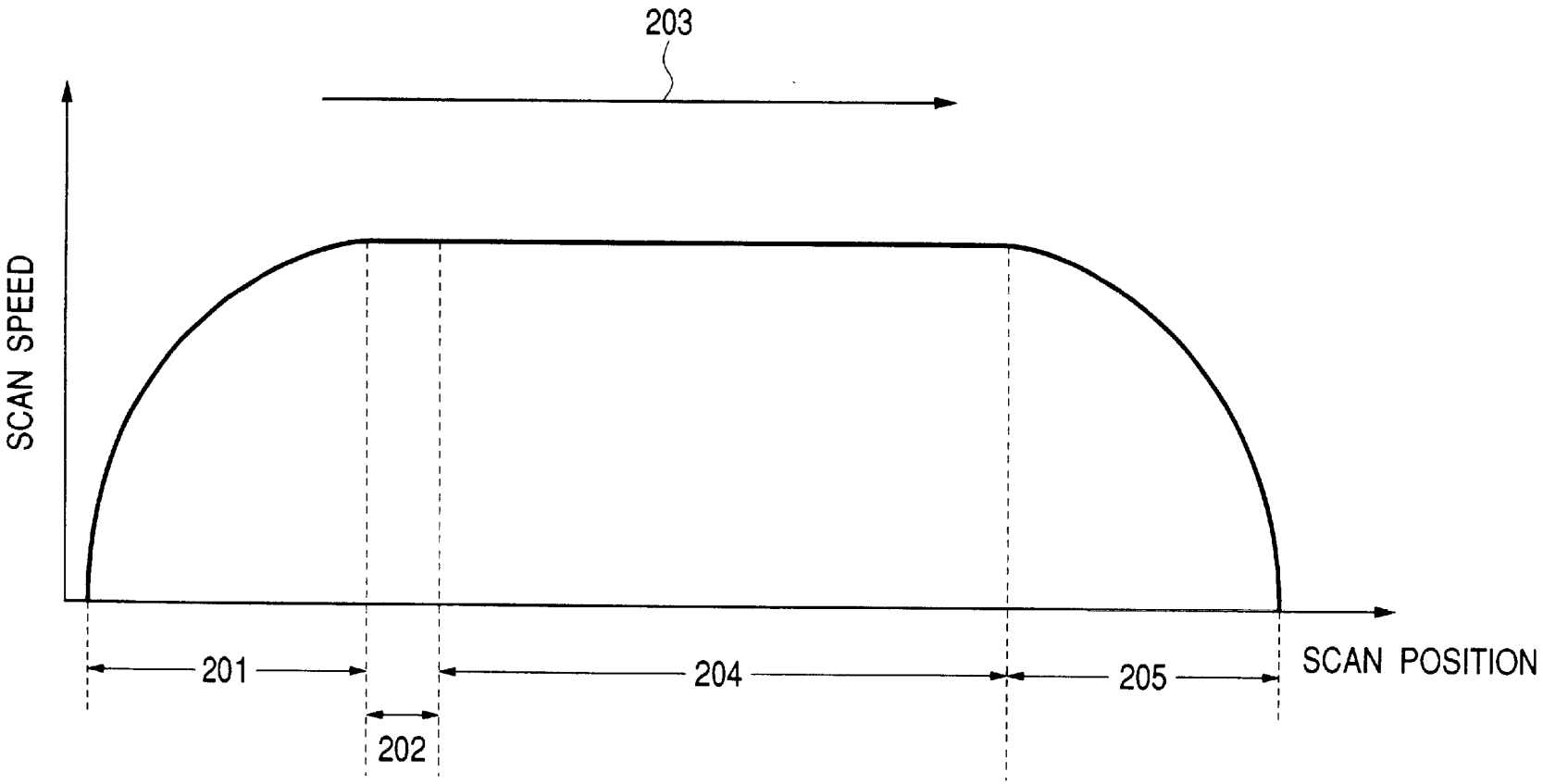
FIG. 2 is a diagram descriptive of a basic control manner for a carriage driving motor according to the embodiment of the present invention.

FIG. 2 is a diagram descriptive of a basic relation between a scan speed and a scan position of the recording head 151 in a case where the recording head 151 records an image while scanning in a direction indicated by an arrow 203. Reference numeral 201 denotes an acceleration area for the carriage driving motor, the accelerating area 201 will hereinafter be referred to as a ramp-up area and a time required for acceleration will hereinafter be referred to as a ramp-up time. Reference numeral 202 denotes a recording head stabilizing area which is set, taking an overshoot following the ramp-up area 201 into consideration, that is, preventing an adverse influence on a recorded image due to the overshoot. The stabilizing area 202 is unnecessary when the recording apparatus is configured so as not to allow the recording head to overshoot. The stabilizing area 202 is assumed to be necessary in the first embodiment. Reference numeral 204 denotes a recording area where the recording head 151 moves at a constant speed and performs a recording operation. Reference numeral 205 denotes a deceleration area for the carriage driving motor, which will hereinafter be referred to as a ramp-down area and a time required for deceleration of the carriage driving motor will hereinafter be referred to as a ramp-down time.

Figure 3:
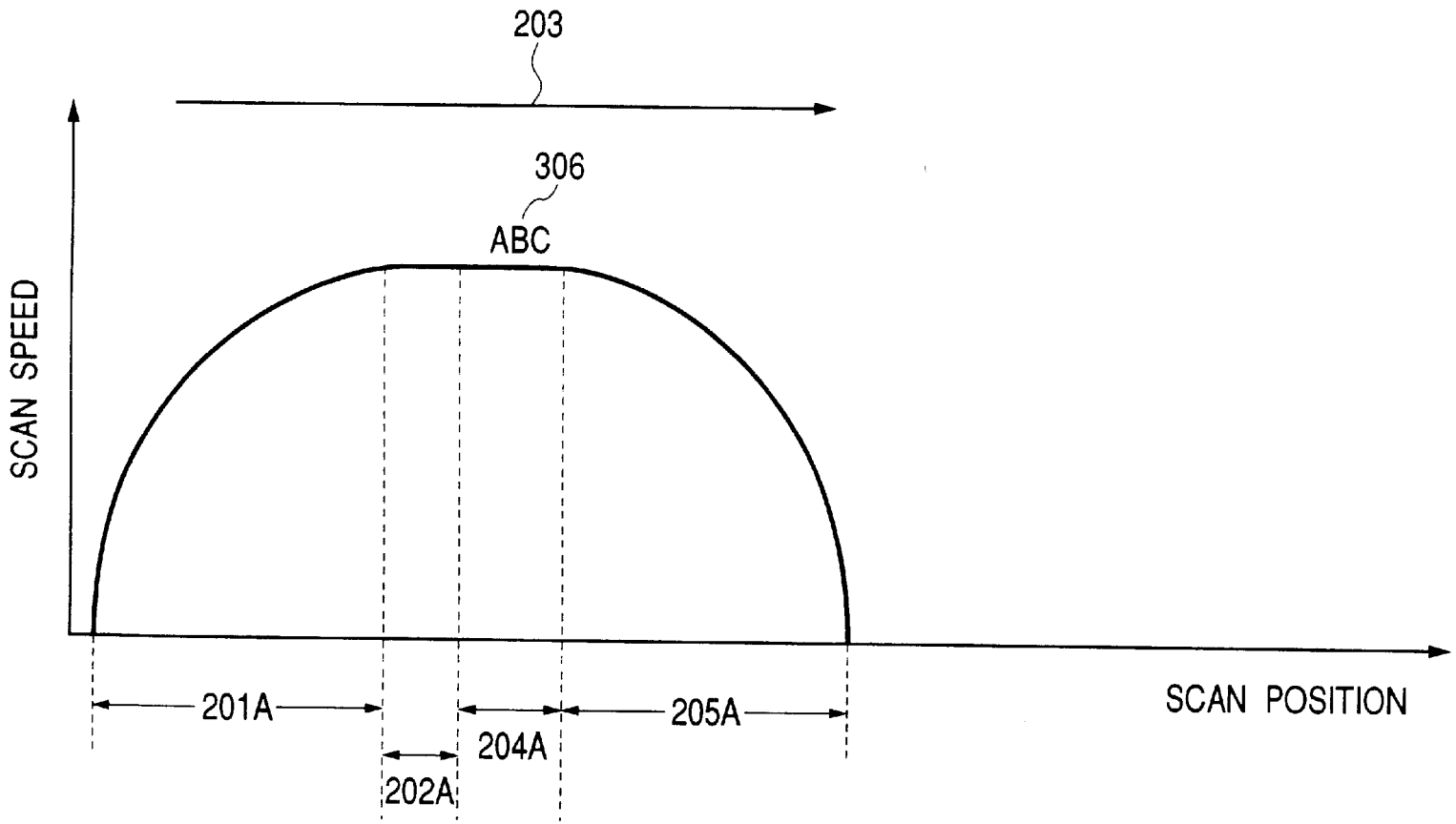
FIG. 3 is a diagram descriptive of a control manner for the carriage driving motor using a first motor driving table according to the embodiment of the present invention.

FIG. 3 is a diagram descriptive of a case where an image 306 of "ABC" is recorded while scanning the recording head 151 in a direction indicated by the arrow 203 using the first motor driving table. In the first embodiment, a stepping motor is used as the carriage driving motor. Reference numeral 201A denotes a ramp-up area which corresponds to 100 pulses for the carriage driving motor. Numbers of pulses used in the following description represent a number of driving pulses for the carriage driving motor. A ramp-up time is 100 msec. Reference numeral 202A denotes a recording head stabilizing area which corresponds to 10 pulses. Reference numeral 204A denotes a recording area which is determined according to recording data 306. The recording area 204A corresponds to 48 pulses in first embodiment. In the areas 202A and 204A, the recording head 151 requires a scanning time of 300 $\mu$sec per pulse. Reference numeral 205A denotes a ramp-down area which corresponds to 100 pulses like the ramp-up area 201A. A ramp-down time is 100 msec.

Figure 4:
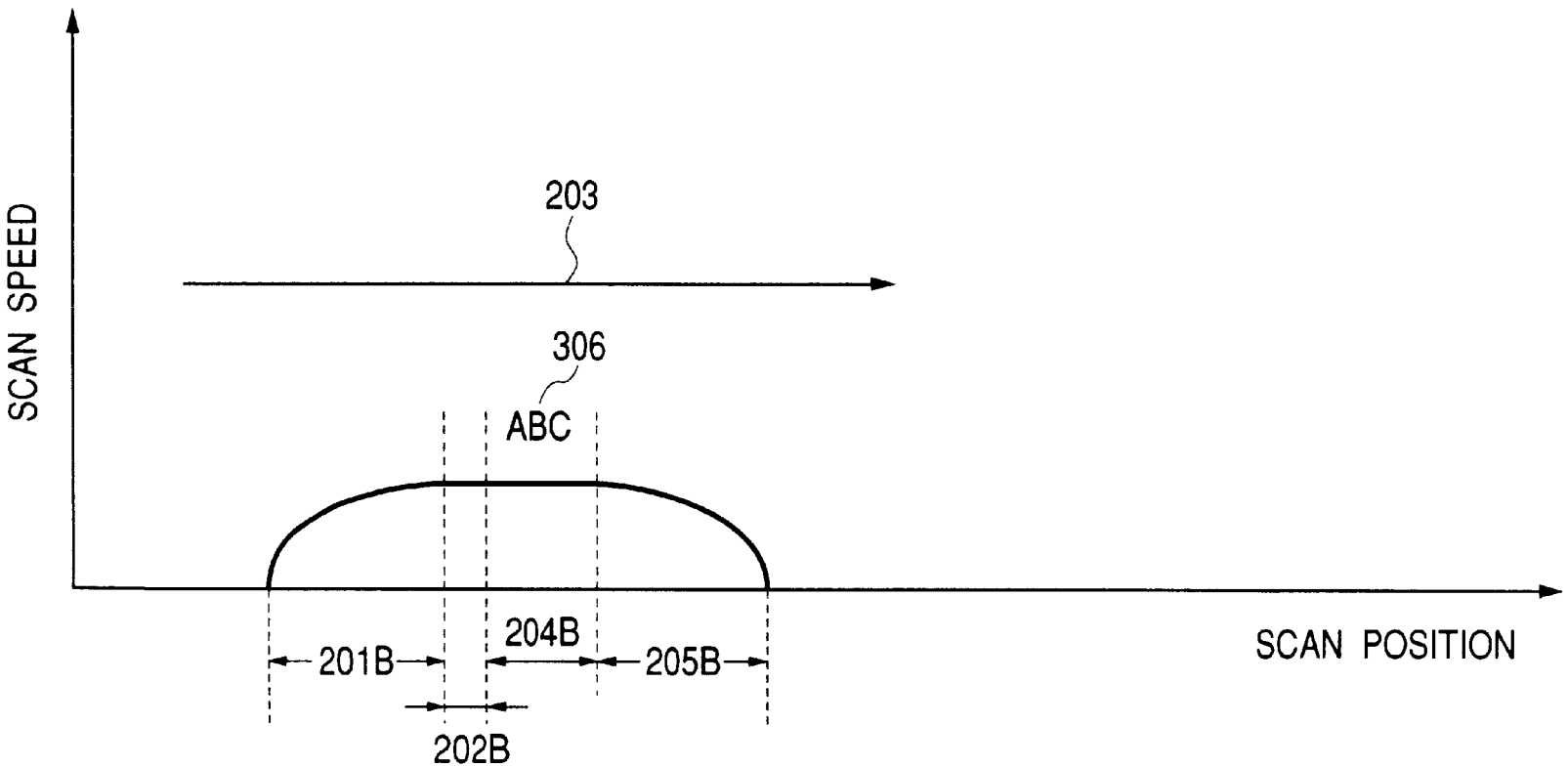
FIG. 4 is a diagram descriptive of a control manner for the carriage driving motor using a second motor driving table according to the embodiment of the present invention.

FIG. 4 is a diagram descriptive of a case where an image 306 of "ABC" is recorded while scanning the recording head 151 in a direction indicated by the arrow 203 using the second motor driving table. Reference numeral 201B denotes a ramp-up area which corresponds to 50 pulses. A ramp-up time is 50 msec. Reference numeral 202B denotes a recording head stabilization area which corresponds to 5 pulses. Reference numeral 204B is a recording area which is determined according to the recording data 306. The recording area 204B corresponds to 48 pulses in the first embodiment. In the areas 202B and 204B, the recording head 151 requires a scanning time of 900 $\mu$sec per pulse and has a scan speed lower than that when the first driving table shown in FIG. 3 is used. Reference numeral 205B denotes a ramp-down area which corresponds to 50 pulses like the ramp-up area 201B. A ramp-down time is 50 msec.

Figure 5:
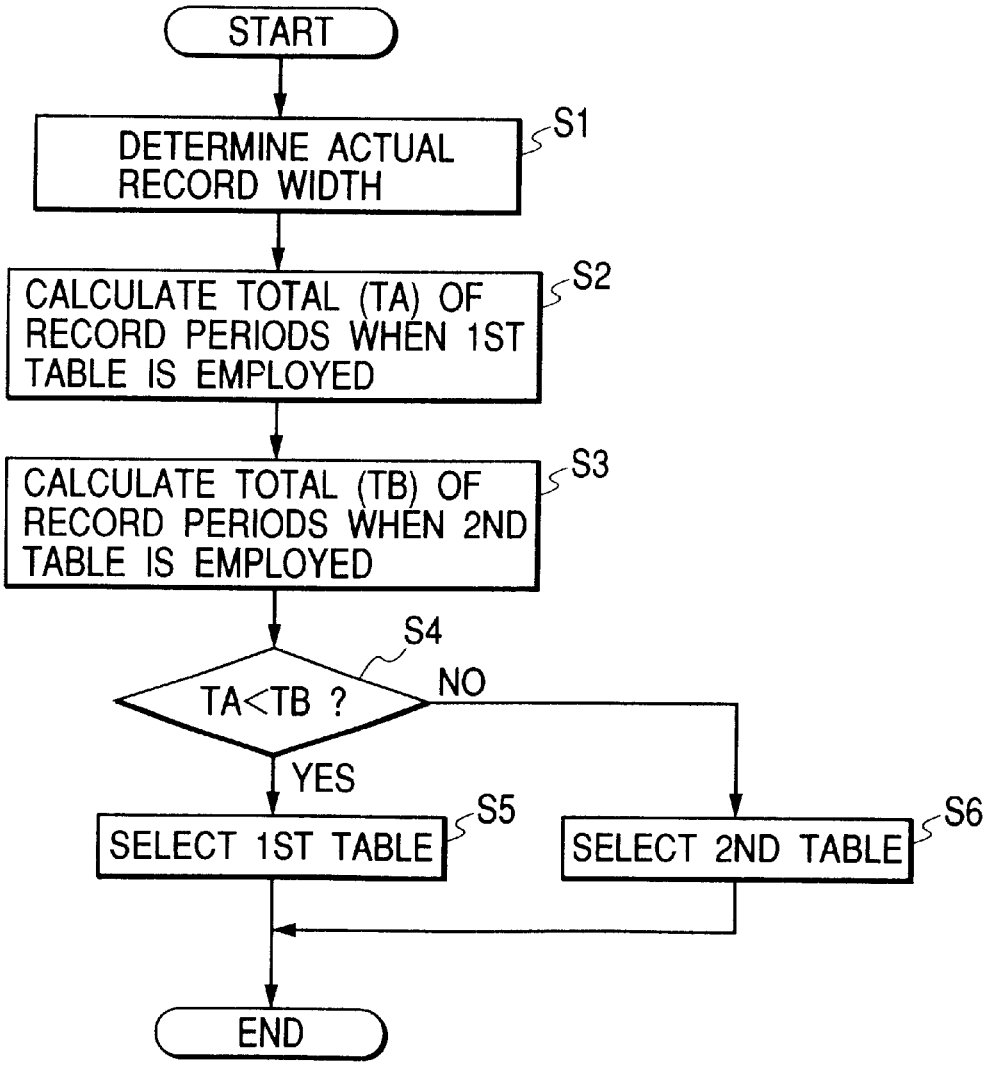
FIG. 5 is a flow chart descriptive of operations for selecting motor driving tables according to the embodiment of the present invention.

FIG. 5 is a flow chart descriptive of a selecting operation for selective use of the first and second motor driving tables shown in FIG. 3 and FIG. 4.

First, an actual record width (actual recording range) corresponding to the recording area 204 is determined (step S1). In the first embodiment, the actual record width corresponds to 48 pulses to record the image 306 of "ABC". Then, a record time is calculated when the first motor driving table is used (step S2). The record time is a total of the ramp-up time, a time to be elapsed in the recording head stabilizing area, a time to be elapsed in the recording area and the ramp-down time. Accordingly, a record time TA is 100+(10×0.3)+(48×0.3)+100=217.4 (msec) when the first motor driving table is used.

Then, a record time to be required is calculated when the second motor driving table is used (step S3). A record time TB is 50+(5×0.9)+(48×0.9)+50=147.7 (msec).

Then, the record time TA is compared with the record time TB (step S4), and the first motor driving table is selected when the record time TA is shorter than the record time TB (step S5) or the second motor driving table is selected when the record time TA is not shorter than the record time TB (step S6). In the first embodiment, since the record time TA (217.4 msec) is not shorter than the record time TB (147.7 msec), the second motor driving table is selected.

As described above, a recording time can be shortened by selectively using the first and second motor driving tables for driving conditions such as a scan speed for the carriage 400, thereby enhancing throughput of the recording apparatus. Furthermore, a motor driving table to be used for control is selected out of a plurality of motor driving tables having an identical actual record width. Thereby, it is capable of properly selecting an optimum motor driving table for shortening a record time. Furthermore, three or more motor driving tables may be prepared so that a motor driving table to be used for control is selected out of a plurality of motor driving tables.

In the first embodiment, the motor driving table to be used for controlling the recording head moving motor is related out of the plurality of motor driving tables according to the recording data of an image to be recorded on a recording medium as described above, thereby being capable of selecting a motor driving table more congruous with contents to be recorded and more preferable as compared with a motor driving table selected simply according to a record mode, and remarkably enhancing throughput as a result.

Second Embodiment

Now, a second embodiment of the present invention will be described with reference to the accompanying drawings. An apparatus configuration and a block configuration according to the second embodiment are similar to those according to the above described first embodiment and will not be described in particular.

In the second embodiment, there is provided an ink jet printer having a high speed recording mode and a normal (standard) recording mode. Between these modes, a carriage moving speed is different. It is assumed for the second embodiment that a carriage speed in the high speed recording mode is approximately twice as high as that in the normal speed recording mode. Three or more recording modes may be prepared and a ratio of carriage speeds among the recording modes is not limited to that exemplified in the second embodiment.

Figure 7:
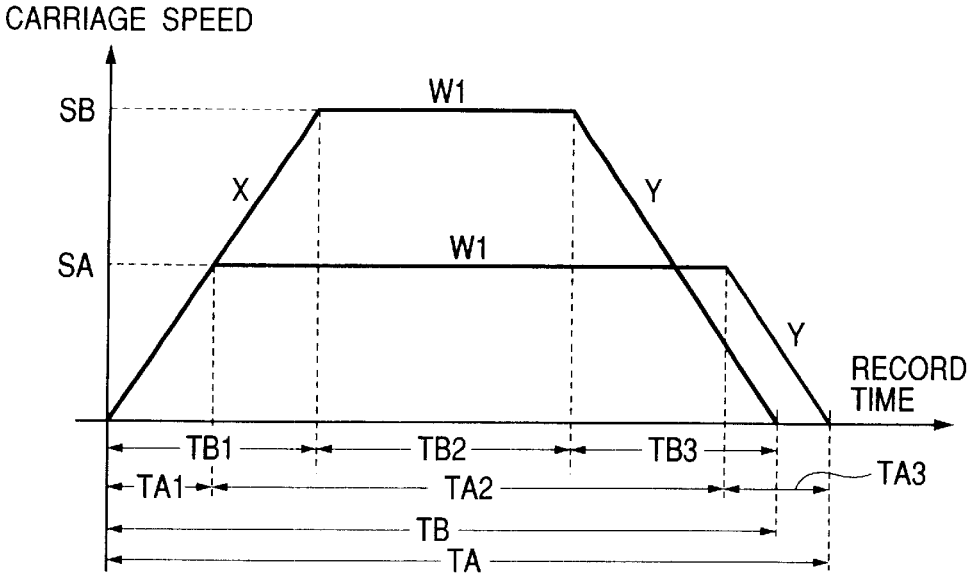
FIG. 7 is a graph showing totals of periods for all scans in a high speed recording mode and a normal speed recording mode when an image having a large width is to be recorded.
Figure 8:
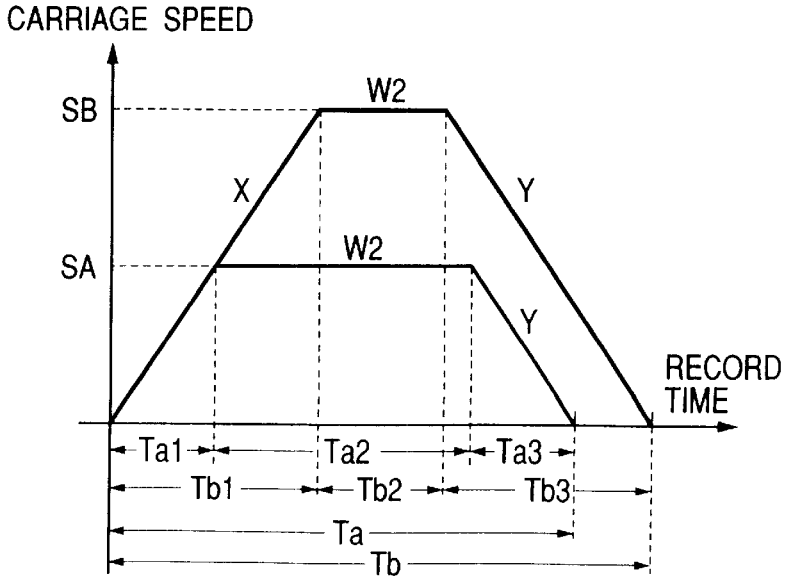
FIG. 8 is a graph showing totals of periods for all scans in the high speed recording mode and the normal speed recording mode when an image having a small width is to be recorded.

FIGS. 7 and 8 are graphs showing acceleration and deceleration profiles of a carriage during scans in the two recording modes. FIG. 7 shows a case where an image to be recorded has a relatively large width in a scan area (record width), whereas FIG. 8 shows a case where an image to be recorded has a relatively small record width. In both the drawings, an ordinate represents a carriage speed and an abscissa represents a time. Furthermore, reference character SA denotes a carriage speed in the normal speed recording mode and reference character SB denotes a carriage speed in the high speed recording mode. It is to be noted that the abscissa represents a scan position in FIGS. 2 through 4.

When an area having a record width W1 is to be recorded in the normal speed recording mode in FIG. 7 showing the case where the record width W1 is relatively large, a carriage speed reaches SA in an acceleration time TA1, actual recording is carried out for a time TA2 and the carriage is stopped after lapse of a deceleration time TA3. In this case, a total of periods for all scans is TA. When the area having the record width W1 is to be recorded in the high speed recording mode, on the other hand, the carriage reaches SB in an acceleration time TB1, actual recording is carried out for a time TB2 and the carriage is stopped after lapse of a deceleration time TB3. In this case, a total of periods for all scans is TB.

Since SB is approximately twice as high as SA in the second embodiment, the acceleration time TB1 and the deceleration time TB3 are twice as long as the acceleration time TA1 and the deceleration time TA3, respectively. Since the record width W1 is relatively large in this case, the actual record time TB2 in the high speed recording mode is not longer than half the actual record time TA2 in the normal speed recording mode and a difference between the actual record times TA2, TB2 is larger than a total of a difference between the acceleration times TA1, TB1 and a difference between the deceleration times TA3, TB3. Comparing the totals of periods for all scans with each other, the total of periods for all scans TB in the high speed recording mode is shorter than the total of periods for all scans TA in the medium speed recording mode.

When an area having a record width W2 is to be recorded in the normal speed recording mode in FIG. 8 showing the case where the record width W2 is relatively small, a carriage speed reaches SA in an acceleration time Ta1, actual recording is carried out for a time Ta2 and the carriage is stopped after lapse of a deceleration time Ta3. In this case, a total of periods for all scans is Ta. When the area having the record width W2 is to be recorded in the high speed recording mode, on the other hand, a carriage speed reaches SB in an acceleration time Tb1, actual recording is carried out for a time Tb2 and the carriage is stopped after a deceleration time Tb3. In this case, a total of periods for all scans is Tb.

Since SB is approximately twice as high as SA in the second embodiment, the acceleration time Tb1 and the deceleration time Tb3 are twice as long as the acceleration time Ta1 and the deceleration time Ta3, respectively. Since the record width W2 is relatively small in this case, a difference between the actual record time Tb2 in the high speed recording mode and the actual record time Ta2 in the normal speed recording mode is smaller than a total of a difference between the acceleration times Ta1, Tb1 and a difference between the deceleration times Ta3, Tb3. Comparing the totals of periods for all scans with each other, the total of periods for all scans Tb in the high speed recording mode is therefore longer than the total of periods for all scans Ta in the normal speed recording mode.

As above-mentioned, it may be caused dependently on a record width that a total of periods for all scans may be longer in the high speed recording mode in which a carriage moving speed is higher. The second embodiment is configured not to fix a carriage moving speed but to control a total of periods for all scans to be shortened when the high speed recording mode is selected. Specifically, the second embodiment preliminarily calculates totals of periods for all scans in record modes in which carriage moving speeds are different, compares the total of periods for all scans with each other and selects a record mode in which the total of periods for all scans is shorter for actual recording.

Description will be made below on calculations of totals of periods for all scans in the two record modes, which calculations are performed before actual recording.

When an acceleration time, an actual record time and a deceleration time are denoted by T1, T2 and T3 respectively, a total T of periods for all scans is:

$$T=T1+T2+T3$$

A coefficient of acceleration is denoted here by X and a coefficient of deceleration is denoted by Y. Denoting a carriage speed for actual recording and a record width by S and W respectively, a total T of periods for all scans can be expressed as:

$$T=S/X+W/S+S/Y=((X+Y)/(X\times Y))\times S+(W/S) \quad (1)$$

When the carriage speed S is substituted for the carriage speed SA and the carriage speed SB in the normal speed recording mode in the formula (1), the total of periods for all scans TA and TB in each record mode is calculated as:

$$TA=((X+Y)/(X\times Y))\times SA+(W/SA) \quad (2)$$

$$TB=((X+Y)/(X\times Y))\times SB+(W/SB) \quad (3)$$

A requirement for obtaining a total of periods for all scans in the high speed recording mode which is longer than a total of periods for all scans in the normal speed recording mode is:

$$TB>TA \quad (4)$$

On the basis of these formulae, the record width W is calculated for each scan by record width calculating means for recording data, the total of periods for all scans TB in the high speed recording mode and the total of periods for all scans TA in the normal speed recording mode are determined, whether a time required for scans in the high speed recording mode is longer than that required for scans in the normal speed recording mode is judged when the formula (4) is satisfied and a carriage speed is set to SA. In other cases, the recording apparatus sets a carriage speed to SB.

Record speed control operations in the second embodiment will be described once again with reference to a flow chart shown in FIG. 9.

First, whether or not the high speed recording mode is selected is determined (step S601). When the high speed recording mode is not selected, a carriage speed corresponding to a recording mode like the conventional printer is set (step S610), a scan for actual recording is executed according to recording data (step S611) and a recording operation is terminated.

When it is determined that the high speed recording mode is selected at step S601, a record width W for a next scan is calculated (step S602). The total of periods for all scans TA in the normal speed recording mode is calculated according to the above mentioned formula (2) (step S603) and the total of periods for all scans TB is calculated according to the above-mentioned formula (3) (step S604).

Then, whether or not the above-mentioned formula (4) is satisfied (step S605) is judged and a carriage speed is set to SA when TB is longer than TA (step S606) or to SB in other cases. Then, scans at the set carriage speed for actual recording (step S608) are executed.

When one recording scan completes as described above, whether or not recording is completed (step S609) is judged, and when the recording is not completed, the sequence returns to the step S602 to perform similar processings for a next scan for recording.

As described above, the second embodiment selects the carriage moving speed so that the total of periods for all scans may be shortest for each scan for recording when the high speed recording mode is selected thereby making a time required for recording in the high speed recording mode always shorter than that in the other mode irrespective of an image to be recorded. Furthermore, a shortest total of periods for all scans sets a carriage stroke width (moving range) at a required minimum value in the high speed recording mode, thereby providing an effect to allow the recording apparatus to produce minimum noise and consume electric power in a small amount.

Third Embodiment

Now, description will be made of a third embodiment of the recording speed control operations according to the present invention. Description will be made only of parts which are different from those of the above described second embodiment without describing parts which are similar to those of the above described second embodiment.

In the above described second embodiment, the record width is calculated for each scan and then the totals of periods for all scans are calculated according to the above-mentioned formulae (2) and (3). The carriage speeds SA and SB are usually determined fixedly, and the acceleration time T1 and the deceleration time T3 are therefore constant.

The third embodiment is configured to simplify the calculations of the totals of periods for all scans by utilizing fixed carriage speeds, constant acceleration times and constant deceleration times. Specifically, acceleration times and deceleration times for the carriage speeds SA and SB are preliminarily calculated and stored in a memory or the like, and only a record time T2 which is changed for each scan dependently on a record width W is calculated, whereby the calculations of totals of periods for all scans are simplified.

Figure 9:
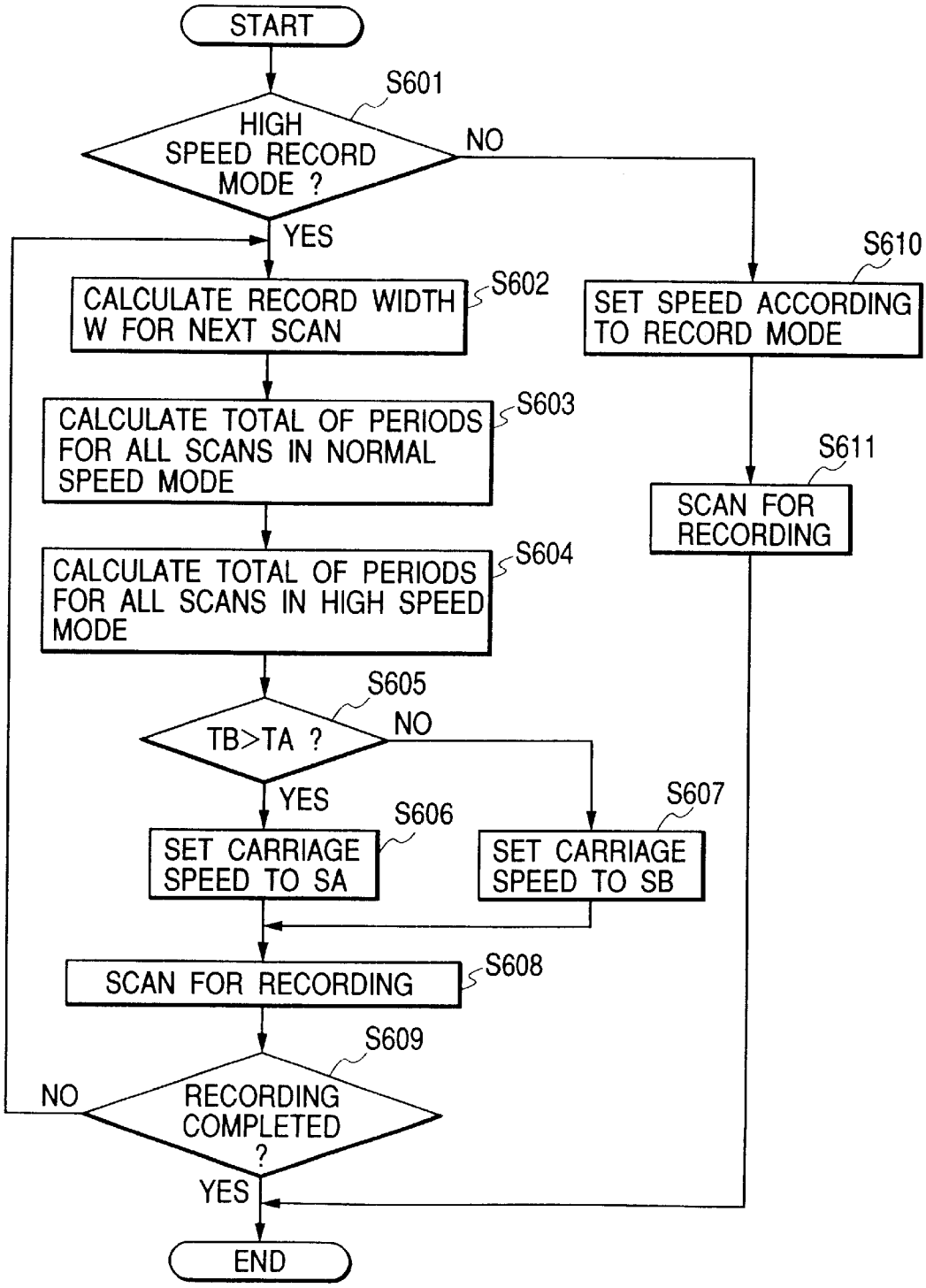
FIG. 9 is a flow chart descriptive of operations for controlling a record speed according to. a second embodiment of the present invention.

Describing with reference to the above described flow chart shown in FIG. 9, a total of the acceleration time and the deceleration time stored in the memory and a record time T2 corresponding to the record width W is calculated at the steps S604 and S605.

The third embodiment which is configured as described above lessens burdens imposed on the calculations and is therefore effective in particular for cases where acceleration and deceleration profiles of a carriage are not linear.

Fourth Embodiment

Description will be made below of a fourth embodiment of the recording speed control operations according to the present invention. Description will be made only of parts which are different from those of the above described second embodiment without describing parts which are similar to those of the above described second embodiment.

As understood from the above described FIGS. 7 and 8, the record width W has only a value at which the total TB of periods for all scans in the high speed recording mode is equal to the total TA of periods for all scans in the normal speed recording mode, in a case where the carriage speeds SA and SB are determined fixedly and the acceleration time T1 and the deceleration time T3 are constant.

The fourth embodiment is configured to determine the record width W by utilizing this fact, and then use the value of the record width at which TA is equal to TB as a threshold value, thereby facilitating to determine a carriage speed to be used for actual recording.

Specifically, it is possible from the formulae (2) through (4) to determine a record width WO at which the total of periods for all scans in the high speed recording mode is equal to the total of periods for all scans in the normal speed recording mode by the following equation:

$$WO=((X+Y)/(X\times Y))\times(SA\times SB) \quad (6)$$

Accordingly, the fourth embodiment stores the threshold value WO in a memory or the like, judges that the total of periods for all scans in the normal speed recording mode is shorter than the total of periods for all scans in the high speed recording mode when a record width for a next scan is smaller than WO and sets a carriage speed SA in the normal speed recording mode as a carriage speed for actual recording.

Describing with reference to the flow chart shown in FIG. 9, the fourth embodiment does not perform the calculations at the steps S604 and S605, but calculates a record width at the step S602 and then at step S605, judges whether or not the record width W is smaller than WO, that is, whether or not WO>W is satisfied.

The fourth embodiment determines the carriage speed to be used for recording only by comparing the record width with the threshold value, thereby further simplifying the recording speed control operations.

Other Embodiments

Although the present invention is applied to the serial type ink jet printer in the above described embodiments, the prevent invention is applicable also to printers other than the ink jet type and can provide similar effects so long as the printers are of the serial type.

The above described embodiments select the carriage moving speed so that the total of periods for all scans is shortest for each scan when the high speed recording mode is elected, thereby always shortening a time required for recording irrespective of an image to be recorded. Furthermore, the shortest total scan time sets the carriage stroke width (moving range) at a required minimum value, thereby providing also the effect to allow the recording apparatus to produce minimum noise and consume a small amount of electric power.

What is claimed is:

1. A recording apparatus for recording an image on a recording medium in accordance with recording data while scanning a recording head with a driving force of a motor, comprising:

control means capable of controlling said motor by selectively using a plurality of motor driving tables; and selecting means for selecting a motor driving table to be used by said control means out of the plurality of motor driving tables according to the recording data of the image to be recorded on the recording medium.

2. The recording apparatus according to claim 1, wherein said selecting means selects the motor driving table which provides a shortest time required for recording the image based on the recording data.

3. The recording apparatus according to claim 1, wherein said selecting means selects the motor driving table according to an amount of the recording data.

4. The recording apparatus according to claim 1, wherein said selecting means selects the motor driving table according to a scan distance of said recording head for recording the image based on the recording data.

5. The recording apparatus according to claim 1, wherein each motor driving table is for controlling a speed of the motor in a scan area including an acceleration area, a constant speed area and a deceleration area of said recording head.

6. The recording apparatus according to claim 1, wherein the plurality of motor driving tables includes motor driving tables corresponding to settable record modes, and wherein said selecting means selects the motor driving table to be used by said control means out of the plurality of motor driving tables including the motor driving tables corresponding to the record modes when one of the record modes is set.

7. The recording apparatus according to claim 6, wherein the motor driving tables corresponding to the record modes include a motor driving table corresponding to a high speed recording mode for scanning said recording head at a high speed.

8. The recording apparatus according to claim 1, wherein said recording head is an ink jet recording head which is capable of discharging ink.

9. The recording apparatus according to claim 8, wherein said ink jet recording head comprises an electrothermal converting element which generates heat energy as ink discharging energy.

10. A recording method for recording an image on a recording medium in accordance with recording data while scanning a recording head with a driving force of a motor, said method comprising the step of:

selecting a motor driving table to be used for controlling said motor out of a plurality of motor driving tables according to the recording data of the image to be recorded on the recording medium when said motor is to be controlled by selectively using the plurality of motor driving tables.

11. A recording apparatus which performs recording while scanning across a recording medium a carriage mounted with a recording head and which is configured to be capable of setting a carriage moving speed selectively out of a plurality of values according to a record mode at a stage of scanning, comprising:

record width calculating means for calculating record widths for recording by scans; and moving speed selecting means for selecting out of the plurality of values a value representing the carriage moving speed at which a total of periods for all scans from start to stop of the carriage is shortest at each of the record widths in a high speed recording mode.

12. The recording apparatus according to claim 11, wherein said moving speed selecting means comprises scan time calculating means for calculating the total of periods for all scans for each of the plurality of values.

13. The recording apparatus according to claim 11, further comprising memory means for storing an acceleration time and a deceleration time which are preliminarily calculated for each of the plurality of values, wherein said moving speed selecting means comprises scan time calculating means for calculating the total of periods for all scans as a total of values stored in said memory means and a time required for moving the carriage for each record width.

14. The recording apparatus according to claim 11, further comprising memory means for storing a threshold value of a preliminarily calculated record width for each of the plurality of values, wherein said moving speed selecting means compares the record width with the threshold value and selects a carriage moving speed out of the plurality of values.

15. The recording apparatus according to claim 11, wherein said recording head is an ink jet recording head which performs recording by discharging ink.

16. The recording apparatus according to claim 11, wherein said recording head is a recording head which discharges ink utilizing heat energy and comprises a heat energy converting element for generating the heat energy to be applied to the ink.

17. A record speed control method for a recording apparatus which performs recording while scanning across a recording medium a carriage mounted with a recording head and which is configured to be capable of setting a carriage moving speed selectively out of a plurality of values at a stage of scanning, comprising:

a record width calculating step of calculating record widths for recording by scans; and a moving speed selecting step of selecting out of the plurality of values a value representing the carriage moving speed at which a total of periods of all scans from start to stop of the carriage is shortest at each of the record widths.

18. The record speed control method for the recording apparatus according to claim 17, wherein said moving speed selecting step comprises a scan time calculating step of calculating the total of periods for all scans for each of the plurality of values.

19. The record speed control method for the recording apparatus according to claim 17, further comprising a step of calculating an acceleration time and a deceleration time for each of the plurality of values, and storing the acceleration time and the deceleration time into memory means, wherein said moving speed selecting step comprises a scan time calculating step of calculating the total of periods for all scans at each of the plurality of values as a total of values stored in the memory means and a time required for moving the carriage for the record width.

20. The record speed control method for the recording apparatus according to claim 17, further comprising a memory step of calculating a record width as a threshold value for each of the plurality of values and storing the threshold values into memory means, wherein the record width is compared with the threshold value and a carriage moving speed is selected out of the plurality of values in said moving speed selecting step.

* * * * *